US006739468B1

(12) United States Patent
Colebrook

(10) Patent No.: US 6,739,468 B1
(45) Date of Patent: May 25, 2004

(54) FREIGHT CONTAINER

(75) Inventor: David Colebrook, Hayling Island (GB)

(73) Assignee: Sea Containers Services Ltd., London (GB)

( * ) Notice: Subject to any disclaimer, the term of this patent is extended or adjusted under 35 U.S.C. 154(b) by 0 days.

(21) Appl. No.: 10/031,884

(22) PCT Filed: Aug. 9, 2000

(86) PCT No.: PCT/GB00/03068

§ 371 (c)(1),
(2), (4) Date: May 20, 2002

(87) PCT Pub. No.: WO01/12530

PCT Pub. Date: Feb. 22, 2001

(30) Foreign Application Priority Data

Aug. 16, 1999 (GB) ..... 9919319

(51) Int. Cl.[7] ..... B65D 88/00
(52) U.S. Cl. ..... 220/1.5; 220/629
(58) Field of Search ..... 220/1.5, 1.6, 629, 220/630, 666

(56) References Cited

U.S. PATENT DOCUMENTS 2,985,482 A * 5/1961 Lion ..... 220/1.5
3,061,134 A * 10/1962 Fesmire et al. ..... 220/1.5
4,357,059 A * 11/1982 Mittelmann ..... 312/321
5,253,975 A * 10/1993 Takaguchi ..... 414/800
5,678,715 A 10/1997 Sjostedt et al.
5,823,375 A 10/1998 Nessfield
6,016,634 A * 1/2000 Sayer ..... 52/648.1

FOREIGN PATENT DOCUMENTS

| | | |
|---|---|---|
| GB | 1258284 | 12/1971 |
| GB | 2130556 | 6/1984 |
| GB | 2329378 | 3/1999 |

* cited by examiner

*Primary Examiner*—Lee Young
*Assistant Examiner*—Joseph C. Merek
(74) *Attorney, Agent, or Firm*—Ladas & Parry

(57) ABSTRACT

A freight container (1) having a base (2) and a roof (5) wherein fittings (8, 9) for lifting the container and/or stacking a second container on the roof are provided with a support strut (24) moveably mounted on the container such that the support strut can be moved from a load-bearing position in which the support strut transfers a load between the fittings and the base during lifting and stacking and a loading position in which the support strut does not substantially impede loading and unloading of the freight container from a side of the container. The support strut is carried on one side of a gate structure (20) hinged to a corner post (3, 4) of the container by a hinge at the opposite side.

14 Claims, 5 Drawing Sheets

FREIGHT CONTAINER

FIELD OF THE INVENTION

Intermodal freight transport in Europe (by road, rail and sea ferry) requires containers of maximum internal volume and minimum tare weight. Current European regulations allow a maximum container length of 13.6 m and a maximum width of 2.5 m/2.55 m. This width can accommodate two rows of 1.2 m standard pallets which, after allowing for practical clearances, allows 40 mm or so at most for each of two side wall structures.

Swapbody containers of 13.6 m currently exist, these containers have corrugated steel sides which are specially strengthened at locations 12.2 m (40 feet) apart along the sides (ie at the "40 feet" location) to provide, in effect, 12.2 m (40 feet) posts. At the top of each 12.2 m (40 feet) post is a standard I.S.O. fitting (corner casting) which allows the container to be top-lifted by a known 12.2 m (40 feet) spreader with twistlock connectors. Also, a standard laden 1 2.2 m (40 feet) container may be stacked on top of such a container.

However, such containers suffer from a drawback that freight cannot be loaded or unloaded except through a rear end door, whereas the great majority of road trailers (of this size) are curtain sided, which has the great advantage of allowing side loading and unloading.

The roof structure of 13.6 m curtainside swapbody containers now in common use is relatively flimsy. This is necessitated by the requirements for maximum side aperture height, which limits the structural depth allowable for the roof (commonly no more than 100 mm approximately). For the same reason, the structural depth of the base has to be kept to a minimum (currently approximately 250 mm) which results in a very flexible base structure which deflects very significantly when under load.

It is therefore impractical to stack a laden 12.2 m (40 feet) unit on top of a 13.6 m curtainside container, nor can a laden 13.6 m curtainside unit be stacked on top of another container, since excessive base deflection would cause unacceptable loadings on the roof of the container underneath. Notionally, a rigid-walled 13.6 m unit could be stacked on a curtainside one, except that significant longitudinal racking forces would arise during transport and it is unlikely that the curtainside container could safely resist these longitudinal forces.

However, there is a strong demand, currently unsatisfied, for 13.6 m curtainside containers which also have the capability of being stacked laden and top-lifted. Top lifting equipment is readily available at most docksides and intermodal depots; whereas, grapple lifting or sling lifting equipment is not readily available, being very specialised. Ship to shore container cranes invariably have top lifting equipment and a Lift On Lift Off (LO-LO) operation is highly desirable for deck cargoes on short-sea ferries. Also, many ferries carry containers stacked two-high below decks on Maffi-type platforms/cassettes. These Maffi cassettes commonly have a capacity of 70,000 kg (70 tonnes) and are rolled on and off the ship (RO-RO) with special tractors. Currently, only a single curtainside container can be transported by this system, resulting in the waste of valuable ship space. In effect, an operator has to pay for two container slots, when moving only one container.

13.6 m curtainside containers currently have I.S.O. fittings (or similar lightweight versions) in their base structure at the 12.2 m ("40 feet") locations. The purpose of these fittings is to allow twistlock connection of the container to a road chassis (trailer), a rail wagon or to a ship's deck. If a full I.S.O. fitting were provided in the roof structure at each 12.2 m ("40 feet") location, and the top and bottom 12.2 m ("40 feet") fittings connected by a structural "post" member, then the container would be top liftable and stackable. Unfortunately, such "posts" would prevent satisfactory side loading and unloading of the container.

One manner for overcoming the difficulty would be to make the 40 feet posts removable, however, this presents a further difficulty in that the post is necessarily heavy and impractical to be removed safely by manpower. Also, it would not be easy to make a satisfactory connection to the container at the top of the post, since the top is a long way from the ground and therefore, not easily accessible.

SUMMARY OF THE INVENTION

It is an object of the present invention to at least mitigate the foregoing difficulties.

According to the present invention there is provided a freight container including a base, a roof, fitting means located on the roof for lifting the container and/or stacking a second container on the roof, and support means moveably mounted on the container, the support means being moveable between a load-bearing position for transferring a load between the fitting means and the base and a loading position in which the support means does not substantially impede loading and unloading of the freight container from a side of the container, wherein the support means is located on gate means (20) hingedly fixed to corner posts (3, 4) in corners of the container.

Conveniently, the support means is a substantially vertical strut.

Advantageously, locking means are provided for locking the support means in the support position.

Conveniently, two fitting means are mounted on the roof proximate a junction of the roof with a side wall of the container, the two fittings being separated by a predetermined distance less than a length of the side wall.

Preferably, the predetermined distance is 12.2 metres (40 feet).

Conveniently, a transverse roof beam is provided to connect fitting means located proximate opposed side walls.

In one embodiment, the present invention overcomes the above noted difficulties by mounting the removable 12.2 m (40 feet) posts on a hinged "gate" structure such that the whole structure can be swung out of the way, yet remain easily in control of the operator. Connections at the top and bottom of the 12.2 m (40 feet) post comprise a spigot and a socket system which automatically engages when the gate is swung "shut". To assist engagement/disengagement the spigots and sockets are tapered.

In order to force the connections into engagement and to hold them securely engaged (also to force them out of engagement) standard door locking gear is used. This comprises a tubular shaft running from the top to the bottom of each "gate". At the ends of the shaft are specially shaped claw-type cams which engage with matching cam-keepers fixed to the main structure. As the shaft is rotated (using a handle or lever near the bottom of the shaft, where it is easily accessible) the "gate" is forced shut and the spigot connections forced into engagement. The handle is then secured in the "shut" position and the top and bottom connections of the 12.2 m (40 feet) post are thereby secured. The first container may now be safely top lifted, also a second laden unit may be stacked on top of the first container.

The achievement of top lift and laden stacking capabilities does involve significant additional tare weight compared with similar containers which do not have these capabilities. The reasons for the extra weight are, of course, the weight of the 12.2 m (40 feet) posts themselves and the associated gate structure, also the weight of a substantial transverse roof beam which is needed to resist the eccentricity moments arising at the I.S.O. top lift fittings. The eccentricity occurs because the 12.2 m (40 feet) post (of necessity) is located close to the 2.5 m outer "envelope" (so as to allow internal width for two 1.2 m pallets side by side) whereas the twistlocks come well inside the ISO 2.438 m "envelope". In addition, the complete structure, in particular the base structure, has to be heavier in order to comply with the international Container Safety Convention (CSC) which is legally obligatory for top liftable containers. In order to obtain CSC Certification the unit has to be tested to 2.0 R (where R equals the maximum gross rated mass) whereas the grapple and sling lifted units do not require CSC Certification, they merely have to comply when CEN standards for swapbodies which call for testing to 1.5 R only.

BRIEF DESCRIPTION OF THE DRAWINGS

The invention will now be described by way of example with reference to the accompanying drawings, in which.

DETAILED DESCRIPTION

Figure 1:
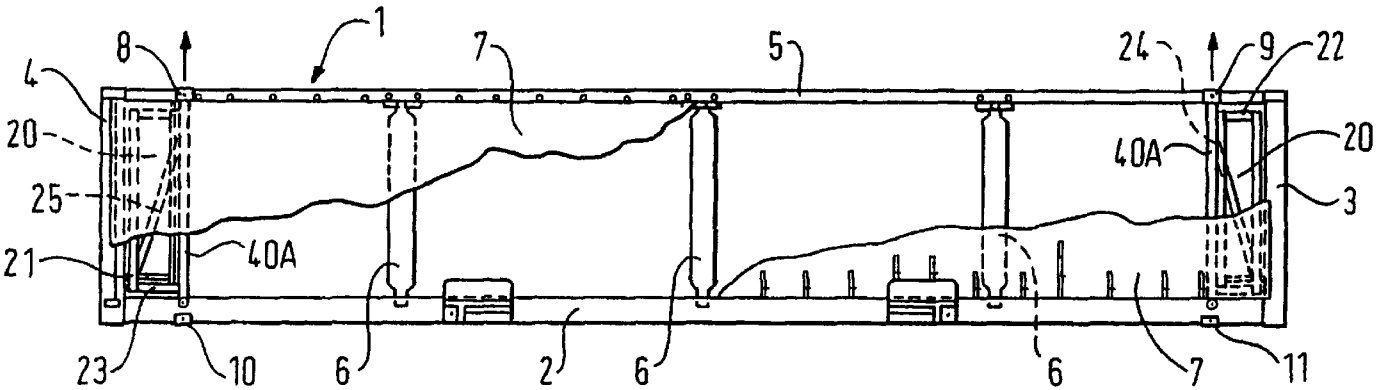
FIG. 1 shows a side view of a freight container according to the invention with the gate in a load-bearing position.

In the figures, like reference numerals denote like parts.

Figure 3:
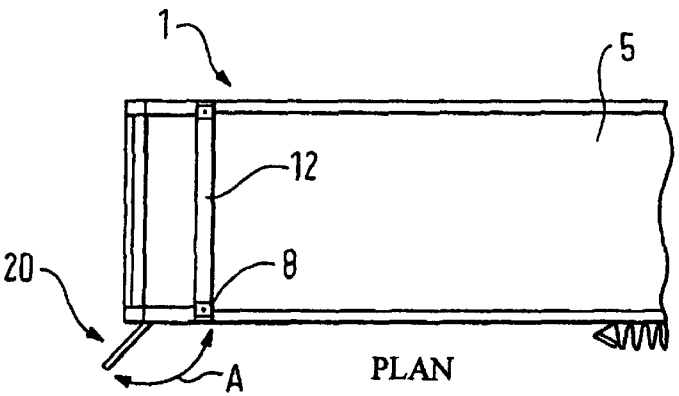
FIG. 3 shows a plan view of the partial view of the container shown in FIG. 2.
Figure 2:
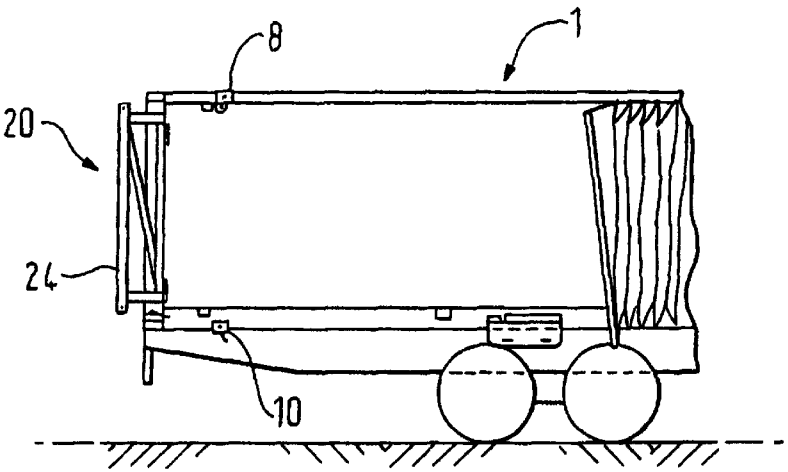
FIG. 2 shows a partial view of the freight container of FIG. 1 mounted on a lorry with the gate in a freight loading/unloading position.
Figure 6:
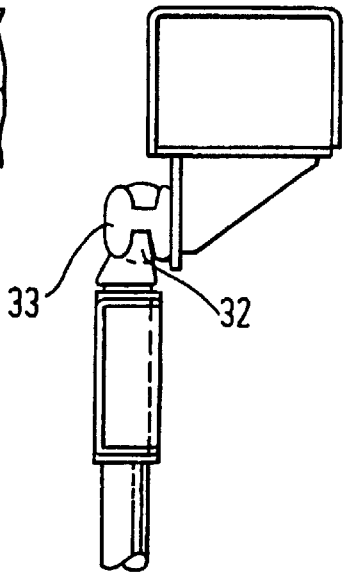
FIG. 6 shows a cross-section along double arrow headed line VI—VI in FIG. 4.
Figure 5:
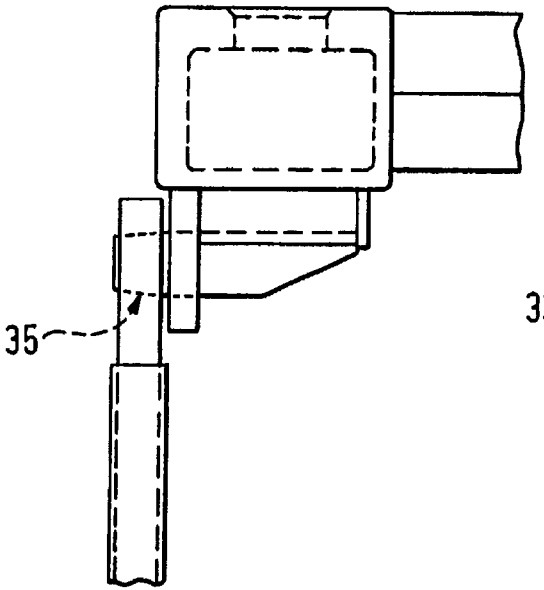
FIG. 5 shows a cross-section along double arrow headed line V—V in FIG. 4.
Figure 4:
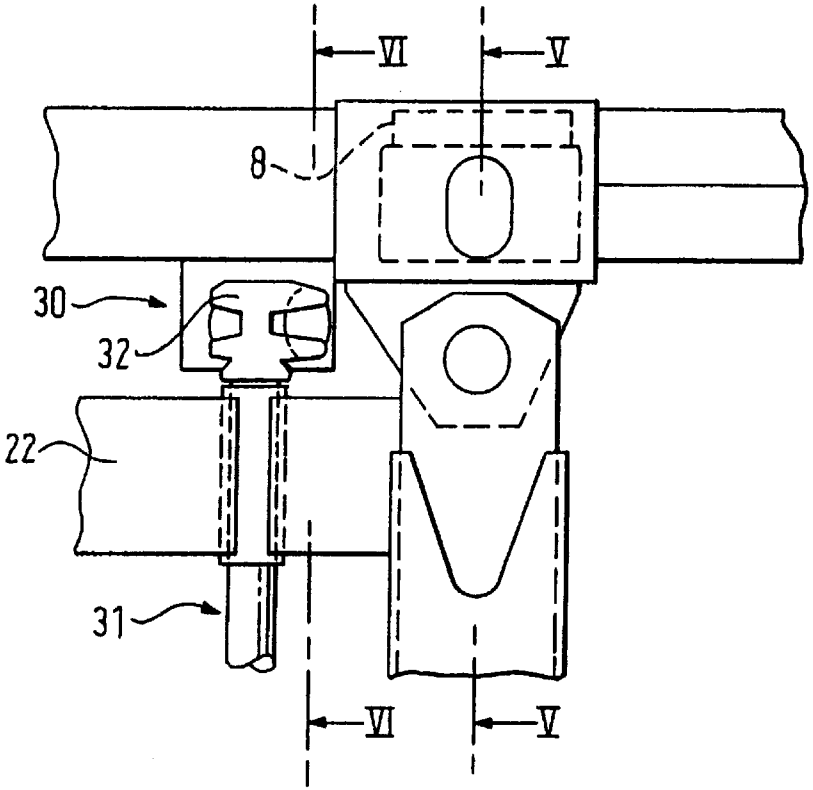
FIG. 4 shows a view of a locking mechanism used in a preferred embodiment of the invention.

As shown in FIGS. 1–3 a freight container 1 of the invention has a base 2 and corner posts 3, 4 supporting a roof 5, the roof being additionally supported by three equally spaced intermediate posts 6 which are movable in a known manner. The sides of the container are closed by a curtain 7 covering the intermediate posts 6, such that the curtain 7 may be drawn aside for loading and unloading the container 1. The container is provided adjacent to its sides on its base and roof with known I.S.O corner fittings 8, 9, 10, 11 which are separated by a distance of 12.2 m (40 feet) along the side of the container such that the roof corner fittings 8, 9 are vertically above the base corner fittings 10, 11 respectively.

There is further provided a gate structure 20 hinged to each of the corner posts 3, 4 including a hinged vertical member 21, top 22 and bottom 23 horizontal members and a load bearing vertical member 24, which is so arranged that in the closed or load-bearing position, the load bearing member 24 is aligned with a roof corner fitting 8, 9 and a base corner fitting 10, 11 respectively to transfer load between them. The structure is further provided with a diagonal member 25 to stabilize the gate structure 20 which diagonal member 25 is fixed between a junction between the lower horizontal member 23 and the hinged vertical member 21 and a junction between the upper horizontal member 22 and the load bearing member 24. As best shown in FIG. 3, the gate structure 20 is hinged so that the gate can rotate through 135° about a vertical axis through the hinges from the closed load bearing position to an open loading/unloading position, as indicated by the double-headed arrow A so that the gate structure 20 does not impede side loading and unloading of the container 1.

As also shown in FIG. 3, the roof 5 is strengthened by a substantial transverse roof beam 12 which is needed to resist eccentricity moments arising at the I.S.O. top lift fittings. This eccentricity occurs because the 12.2 m (40 feet) post is (of necessity) located close to the 2.5 m outer "envelope" (so as to allow internal width for two 1.2 m pallets side by side), whereas the twistlocks come well inside the I.S.O. 2.438 m "envelope".

To load or unload the container 1, the curtain 7 is drawn aside and the intermediate moveable posts 6 removed in a known manner and the gate structure 20 is moved from the load-bearing position to the open loading/unloading position. When the loading or unloading is completed, the gate structure 20 is moved to the load-bearing position and locked in position in a manner to be described. The moveable posts 6 are replaced and the curtain 7 closed.

As shown in FIGS. 4 to 6, and FIG. 12, the gate 20 is locked in the load-bearing position by a known door locking mechanism 30 in which standard door locking gear is used to force the connections into engagement and to hold them securely engaged. (The door locking gear is also used to force the connections out of engagement to open the gate.) The locking gear comprises a tubular shaft 31 running from top to bottom of each "gate" 20. At the ends of the shaft are specially shaped claw-type cams 32 which engage with matching cam-keepers 33 fixed to the main structure. As the shaft 31 is rotated using a handle or lever 34 (FIG. 12) near the bottom of the shaft 31, where it is easily accessible, the "gate" 20 is forced shut and spigot connections 35 forced into engagement. The handle 34 is then secured in the "shut" position and the top and bottom connections of the 12.2 m (40 feet) post 24 are thereby secured. A first container 1 may now be safely top lifted, also a second laden container may be stacked on top of the first container.

Figure 7:
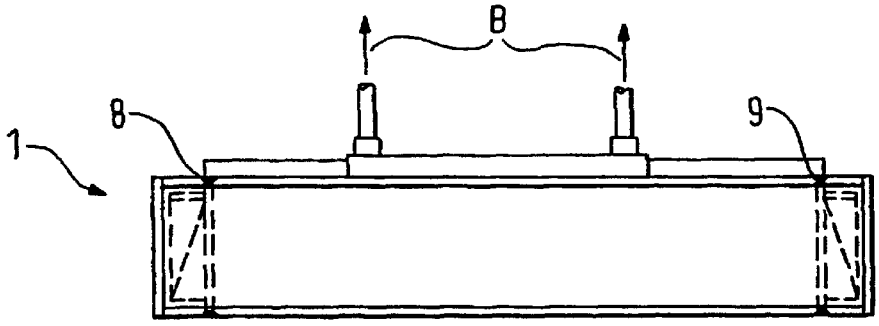
FIG. 7 shows a container of the invention being lifted.
Figure 8:
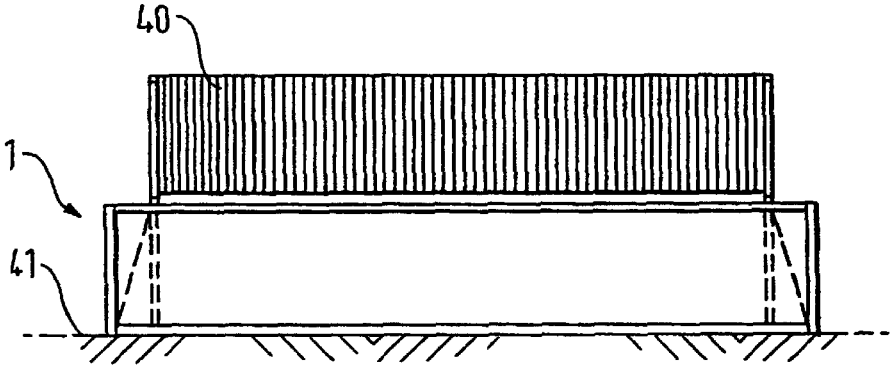
FIG. 8 shows a container shorter than the container of the invention, stacked on a roof of a container of the invention.
Figure 9:
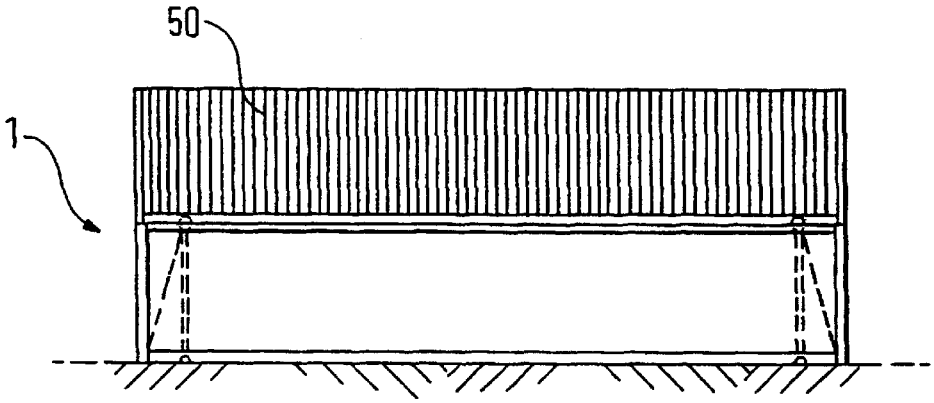
FIG. 9 shows a container of the same length of the container of the invention, loaded on a container of the invention.

FIGS. 7–11 show the container 1 of the invention in use with the gate 20 in the closed or load-bearing support position. As shown in FIG. 7, the container 1 can be lifted in the direction of arrows B when fully laden, using known top lifting equipment and twistlock connections to the roof fittings 8, 9. FIG. 8 illustrates a laden I.S.O. 12.2 m (40 feet) container 40 stacked on a curtain-sided container 1 of the present invention on a ship's deck 41, ie, for a lift on/lift off system. A similar application is shown in FIG. 9, where a 13.6 m swapbody 50 with rigid walls is stacked on top of a container 1 of the present invention.

Figure 10:
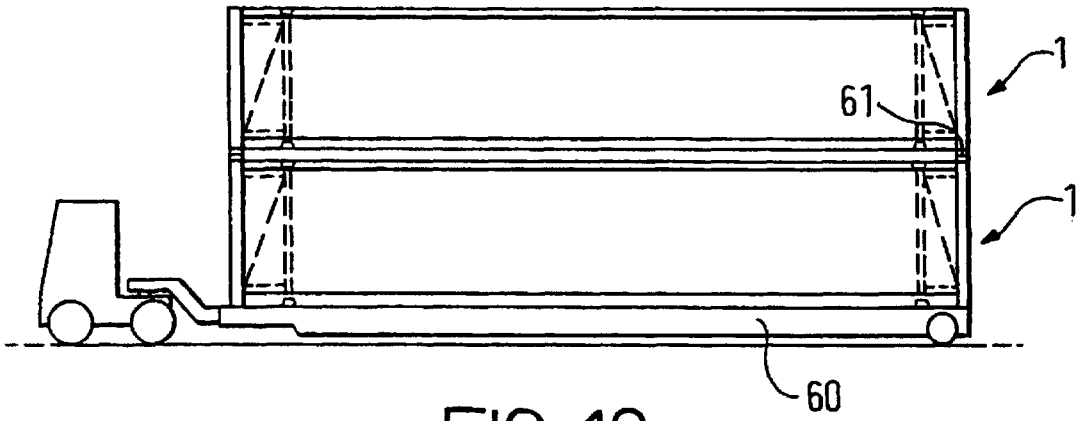
FIG. 10 shows two containers of the invention stacked one above the other on a cassette for loading on a roll on/roll off ferry.
Figure 11:
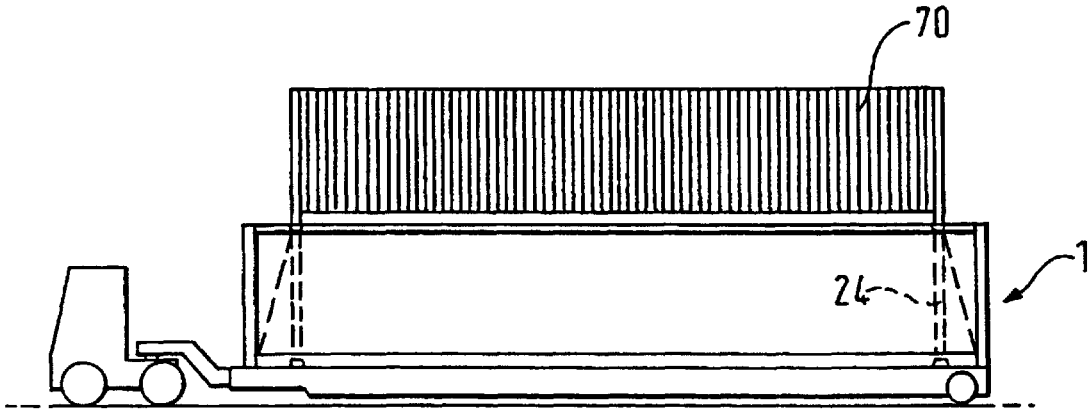
FIG. 11 shows a container shorter than the container of the invention stacked on a container of the invention, loaded on a cassette for loading on a roll on/roll off ferry.

As shown in FIG. 10, two laden containers 1 of the present invention may be stacked on a 70 tonne "Maffi"-type cassette 60 for loading onto a roll on/roll off ferry. Spacers 61 are provided between the stacked containers to allow flexing of the base of the upper container. Similarly, as illustrated in FIG. 11, an I.S.O. 12.2 m (40 feet) container 70 may be stacked on a container 1 of the present invention, the load being transmitted to the base through the load-bearing member 24.

Figure 12:
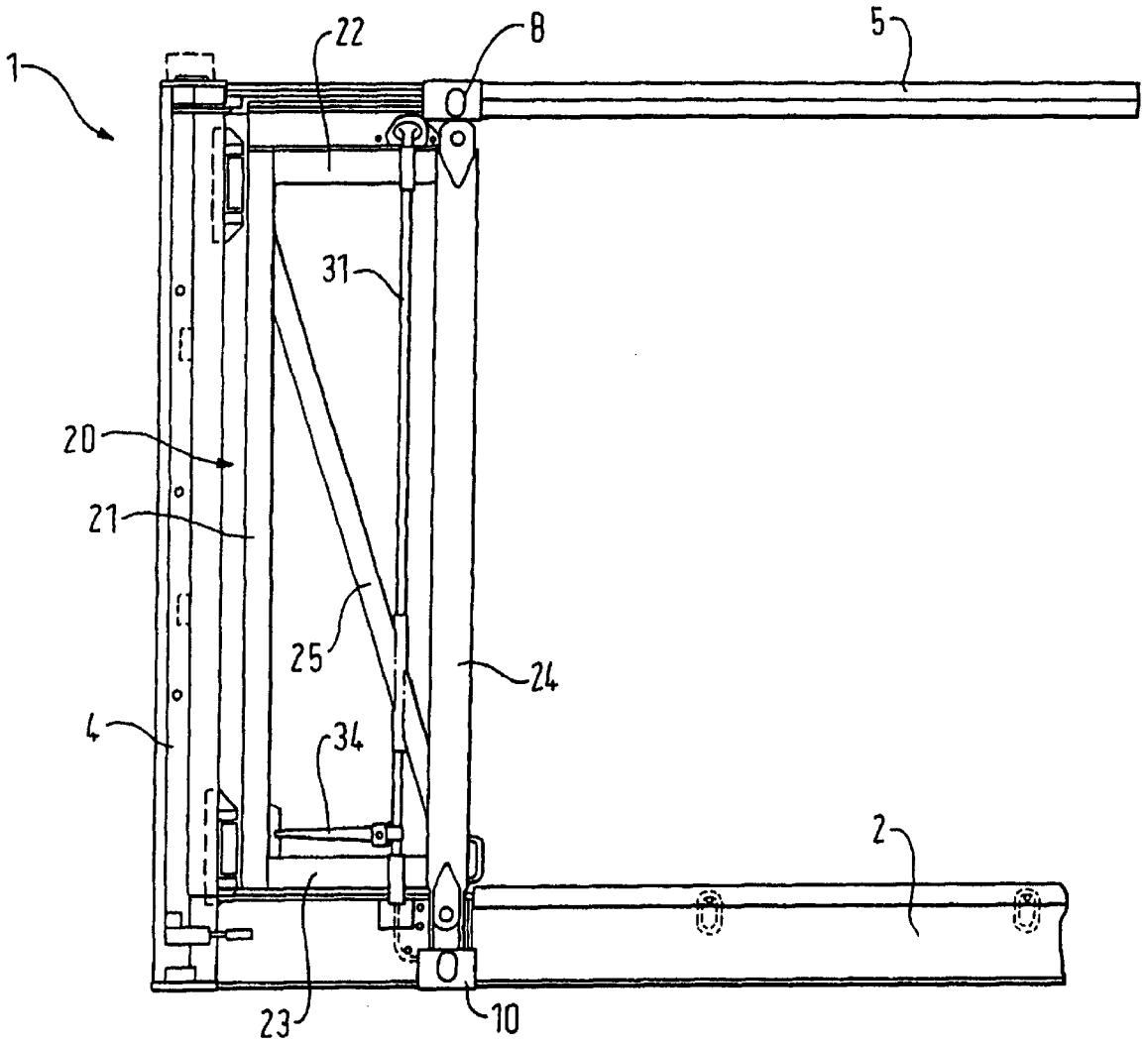
FIG. 12 shows details of the gate of FIG. 1.

FIG. 12 shows details of the gate 20.

What is claimed is:

1. A freight container (1) including a base (2), corner posts (3, 4) located on the base in corners of the container to support a roof (5), fitting means (8, 9) located on the roof for lifting the container and/or stacking a second container on the roof, and a substantially vertical struts (24) moveably mounted on the container, the substantially vertical struts being moveable between load-bearing positions for transferring a load between the fitting means and the base and loading positions in which the substantially vertical struts do not substantially impede loading and unloading of the freight container, gate means (20) swingable between an open position for loading and unloading the container and a closed position for the containers said gate means having first and second opposite sides, said gate means (20) being hingedly fixed to respective said corner posts (3, 4) by hinge means on the first side of the gate means and the substantially vertical struts each being located on the gate means at the second opposite side of the gate means remote from the hinge means.

2. A freight container as claimed in claim 1, wherein locking means (30) are provided for locking the substantially vertical strut in the support position.

3. A freight container as claimed in any of the preceding claims, wherein two of the fitting means (8, 9) are mounted on the roof proximate a junction of the roof with a side wall of the container, the two fitting means being separated by a predetermined distance less than a length of the side wall.

4. A freight container as claimed in claim 3, wherein the predetermined distance is 12.2 meters (40 feet).

5. A freight container as claimed in claim 1, wherein each said vertical strut is secured at said second opposite side of the gate means for being swung outwardly and away from the container as said gate means is swung to said open position.

6. A freight container as claimed in claim 5, wherein each said strut is outside the container in said open position of the gate means.

7. A freight container as claimed in claim 5, wherein each said strut extends along said second side of said gate means over substantially the entire length of said second side.

8. A freight container as claimed in claim 5, wherein each said strut extends continuously along said second side of the gate means.

9. A freight container as claimed in claim 1, wherein said container has side walls and end walls, said gate means being disposed at one of said side walls of the container.

10. A freight container as claimed in claim 9, wherein said fitting means comprises two fitting members spaced apart on the roof at said one of the side walls of the container.

11. A freight container as claimed in claim 1, wherein with said gate means in said loading position and the vertical struts do not impede loading and unloading of the container, there is clear open space between the roof and the base at said fitting means.

12. A freight container as claimed in claim 1, wherein said gate means comprises a swingable gate members which open and close an opening in the container, each said gate member having one side edge hingeably connected to a respective said corner post and an opposite side edge at which a respective said substantially vertical strut is secured, said locking means comprising locking members on said vertical struts at upper and lower ends thereof for respective connection to said fitting means and said base for locking said gate members in the closed position and engaging said vertical struts in said load-bearing positions.

13. A freight container as claimed in claim 12, wherein in said closed position of the gate members, said vertical struts are disposed at an intermediate location between two corner posts.

14. A freight container as claimed in claim 12, wherein said locking members include claw-shaped cams and matching cam keepers.

* * * * *

UNITED STATES PATENT AND TRADEMARK OFFICE

CERTIFICATE OF CORRECTION

PATENT NO. : 6,739,468 B1
DATED : May 25, 2004
INVENTOR(S) : David Colebrook

It is certified that error appears in the above-identified patent and that said Letters Patent is hereby corrected as shown below:

Title page,
Item [*] Notice, "0" should read -- 4 --.

Signed and Sealed this

Twentieth Day of July, 2004

JON W. DUDAS
*Acting Director of the United States Patent and Trademark Office*